US010286417B2

(12) United States Patent
Ebenbeck et al.

(10) Patent No.: US 10,286,417 B2
(45) Date of Patent: May 14, 2019

(54) METALLIC COATING DEVICE AND METHOD, AND HOLDING UNIT FOR THE DEVICE

(71) Applicant: Sturm Maschinen- & Anlagenbau GmbH, Salching (DE)

(72) Inventors: Andreas Ebenbeck, Straubing (DE); Gerhard Aufschlaeger, Plattling (DE); Marc Kesting, Straubing (DE); Ralf Voellinger, Straubing (DE)

(73) Assignee: Sturm Maschinen- & Anlagenbau GmbH, Salching (DE)

( * ) Notice: Subject to any disclaimer, the term of this patent is extended or adjusted under 35 U.S.C. 154(b) by 41 days.

(21) Appl. No.: 15/325,956

(22) PCT Filed: Jun. 22, 2015

(86) PCT No.: PCT/EP2015/063903
§ 371 (c)(1),
(2) Date: Jan. 12, 2017

(87) PCT Pub. No.: WO2016/015922
PCT Pub. Date: Feb. 4, 2016

(65) Prior Publication Data

US 2017/0157633 A1 Jun. 8, 2017

(30) Foreign Application Priority Data

Jul. 30, 2014 (EP) ..... 14179138

(51) Int. Cl.
*B05B 14/10* (2018.01)
*B05C 11/10* (2006.01)
(Continued)

(52) U.S. Cl.
CPC ..... *B05B 14/10* (2018.02); *B05B 1/28* (2013.01); *B05B 7/222* (2013.01);
(Continued)

(58) Field of Classification Search
CPC ..... B05C 11/1039; B05C 15/00; B05C 19/06; Y10S 118/07; C23C 4/12; C23C 4/134;
(Continued)

(56) References Cited

U.S. PATENT DOCUMENTS 3,741,149 A * 6/1973 Gerlovich ..... B05B 3/1021 118/677
5,176,412 A 1/1993 Washizu
(Continued)

FOREIGN PATENT DOCUMENTS

DE 101 30 455 A1 1/2002
EP 1 980 328 A2 10/2008
(Continued)

OTHER PUBLICATIONS

International Search Report issued in PCT/EP2015/063903, dated Sep. 29, 2015.
(Continued)

*Primary Examiner* — Laura Edwards
(74) *Attorney, Agent, or Firm* — Studebaker & Brackett PC

(57) ABSTRACT

The invention relates to a device and a method for the metallic coating of a work piece with a mobile coating lance (20), by means of which a metal plasma jet can be generated to create the coating consisting of metal particles. According to the invention, an extraction hood (30) is provided, which at least encloses an axial section of the coating lance (20) in a ring-shaped manner, and the extraction hood (30) has a ring-shaped holding unit (50), which is configured to take up the metal particles.

12 Claims, 4 Drawing Sheets

(51) Int. Cl.

| | |
|---|---|
| ***B05C 19/06*** | (2006.01) |
| ***B05B 7/22*** | (2006.01) |
| ***B05B 13/06*** | (2006.01) |
| ***C23C 4/134*** | (2016.01) |
| ***B05B 1/28*** | (2006.01) |
| ***B05B 15/555*** | (2018.01) |
| ***B05B 15/68*** | (2018.01) |
| ***C23C 4/12*** | (2016.01) |

(52) U.S. Cl.
CPC ..... *B05B 13/0636* (2013.01); *B05B 13/0654* (2013.01); *B05B 15/555* (2018.02); *B05B 15/68* (2018.02); *B05C 11/1039* (2013.01); *B05C 19/06* (2013.01); *C23C 4/12* (2013.01); *C23C 4/134* (2016.01); *Y10S 118/07* (2013.01)

(58) Field of Classification Search
CPC ..... B05B 14/10; B05B 15/68; B05B 15/555; B05B 1/28; B05B 13/0636; B05B 7/222; B05B 13/0654; Y02P 70/36
USPC ..... 118/715, 326
See application file for complete search history.

(56) References Cited

U.S. PATENT DOCUMENTS 6,395,090 B1 * 5/2002 Shepley ..... B05B 12/20 118/504
2001/0054654 A1 * 12/2001 Miyai ..... C23C 4/16 239/225.1
2005/0170099 A1 8/2005 Gadow et al.
2013/0000550 A1 1/2013 Brown et al.
2014/0318449 A1 * 10/2014 Slaybaugh ..... C23C 16/52 118/697

FOREIGN PATENT DOCUMENTS

EP 2 455 510 A2 5/2012
WO 2004/005575 A2 1/2004

OTHER PUBLICATIONS

International Preliminary Report on Patentability (Chapter I) and Written Opinion of the International Searching Authority; PCT/EP2015/063903 dated Jan. 31, 2017.

European Search Report issued by the European Patent Office dated Dec. 10, 2014, which corresponds to European Patent Application No. 14179138 and is related to U.S. Appl. No. 15/325,956.

An Office Action mailed by the Korean Intellectual Property Office dated Jun. 13, 2018, which corresponds to Korean Patent Application No. 10-2017-7001899 and is related to U.S. Appl. No. 15/325,956.

* cited by examiner

METALLIC COATING DEVICE AND METHOD, AND HOLDING UNIT FOR THE DEVICE

The invention relates to a device for the metallic coating of a workpiece with a mobile coating lance, through which a metal plasma jet can be generated to form the coating of metal particles.

The invention further relates to a holding unit for this device for metallic coating of a workpiece.

Furthermore the invention relates to a method for metallic coating of a workpiece, wherein a metal plasma jet is generated by means of a coating lance, through which the coating of metal particles is formed on the workpiece.

In particular in engine construction it is necessary to provide the running surfaces of cylinder bores with a special metallic coating in order that adequate friction and lubrication conditions can be guaranteed between a cylinder running surface and a cylinder piston. This applies particularly when both the engine housing and also the cylinder piston are produced from the same material, for example aluminium.

It is known to apply a metal coating directly to a bore wall by means of a coating lance, with which a metal plasma jet is generated. In this way, very thin-walled and very stable metal coatings can be formed on bore walls.

The coating lance is moved into a cylinder bore of an engine block, wherein the generated metal plasma jet is directed onto the bore wall. Due to a certain dispersal of the metal plasma jet, not all metal particles reach the bore wall. These metal particles that are not applied are referred to as overspray. This can lead to undesired defective coatings in the engine block or on the coating device.

DE 101 30 455 A1 and EP 1 980 328 A2 disclose devices for metallic coating of cylindrical workpieces. Both devices have a coating lance and a means for drawing off overspray, which are arranged on opposite sides of the workpiece.

To avoid defective coatings it is known, when moving the coating lance out of a bore of the workpiece, to switch off the metal plasma jet and not to switch it back on again until the coating lance has moved into a further bore to be coated. Both upon switching off and also upon switching on the metal plasma jet, the metal plasma jet reducing or building up can lead to intensified overspray. In addition switching-off and switching-on processes can result in layer thickness deviations on the workpiece. These layer thickness deviations impair the quality and can lead to the whole workpiece being rejected.

It is the object of the invention to indicate a device and a method for metallic coating of a workpiece and also a holding unit for the device, with which efficiency and quality can be improved in the production of a metal coating.

The object is achieved according to the invention with a device having the features described herein, a holding unit having the features described herein and a method having the features described herein. Preferred embodiments of the invention are indicated as noted in detail below.

The device according to the invention is characterised in that an extraction hood is provided, which annularly encloses at least an axial portion of the coating lance, and the extraction hood has a ring-shaped holding unit which is designed for the deposit of metal particles.

A core idea of the invention can be seen in that the coating lance is annularly enclosed along an axial portion by an extraction hood. Thereby, the extraction hood can take up ambient air with an overspray of metal particles through a targeted air flow. Here, the term "extraction hood" is not to be understood solely in that, through a corresponding vacuum, the affected ambient air is sucked from the coating lance into the extraction hood and removed via a waste air pipe. Instead, an air or inert gas flow can also be produced through the extraction hood, through which loaded ambient air is guided to a discharge line in the region of the extraction hood.

All in all, a reliable removal of excess metal particles can be achieved so that the risk of undesired defective coatings on the workpiece or on production means is avoided or at least considerably reduced.

A further aspect of the invention, which can also be seen as separate or independent of the aforementioned core idea, is that a ring-shaped holding unit is provided that is designed for the deposit of metal particles. Metal particles of the plasma jet that do not adhere to the workpiece at the points provided can be purposefully taken up in the holding unit and deposited there. This holding unit can hereby be a replaceable part which is regularly exchanged if there is an excess deposit of metal particles.

In principle the ring-shaped holding unit can be arranged at the lower end of the extraction hood. It is particularly advantageous according to one embodiment of the invention that the holding unit is mounted within the extraction hood so that it can be exchanged. The drum-shaped holding unit is preferably arranged in a lower region of the extraction hood so that, when the coating lance is moved out of the workpiece, the workpiece is moved directly into the drum-shaped holding unit while the metal plasma jet continues, wherein the plasma jet is directed onto a peripheral wall of the holding unit. The metal plasma jet does not therefore have to be switched off and the problems with switching on and off are thus avoided. The metal particles are directly received by the drum-shaped holding unit which can have a diameter of preferably between 10 cm and 50 cm. Smaller or larger diameters are possible, however, in dependence upon the type of coating lance and are expressly not excluded. The overspray resulting during coating of the holding unit is additionally reliably removed through the extraction hood. As soon as an excess coating has formed on the holding unit, for example after several hours, one day or several days, the holding unit can be dismantled and replaced by a new holding unit.

According to one development of the invention, the exchangeability is thus particularly efficient as the extraction hood has a cover hood and a bottom plate which is arranged on a lower side of the cover hood, and the ring-shaped holding unit is arranged in a releasable manner on the bottom plate.

In particular it is thereby advantageous that the bottom plate is releasably fixed to the cover hood by means of at least one quick release device. When a predetermined layer thickness of the deposited metal particles is reached the bottom plate can thus be rapidly removed by removing the bottom plate and releasing the holding unit from the bottom plate and be replaced by a new holding unit as a replaceable element. As it is held on the bottom plate the holding unit can be formed with relatively thin walls and thus with greater material saving and cost saving.

The replacement can be carried out manually or by an automatic replacement unit. The replacement can be carried out at predefined times or when a predefined boundary coating thickness is reached. This can be determined optionally via a corresponding sensor device, for example an optical sensor or a weight sensor, or by a computer based on operating data, so that replacement of the holding unit can take place in accordance with requirements.

According to a further embodiment of the invention it is advantageous that the bottom plate has a central opening, on which an annular flange is provided which has a radially inwardly falling conical surface. All in all, a relatively narrow, inclined surface is formed which constitutes a transition through the bottom plate to the holding unit. The radially inwardly falling conical surface is designed so that impacting metal particles cannot be deposited, or can hardly be deposited, on this conical surface but instead are deflected to the holding unit.

One advantageous development according to the invention exists in that the conical surface is formed with an anti-adhesion property. The anti-adhesion property can be achieved by means of a suitable coating or a suitable material selection for the annular flange. In particular non-ferrous metal alloys can cause metal particles from the plasma jet not to stick, or only to stick to a reduced extent, to the conical surface. The anti-adhesion property can also be achieved by other suitable material combinations.

A further possibility for producing or further improving the anti-adhesion property is to form the conical surface with a slight roughness. This can be realised for example by polishing.

A particularly useful embodiment of the invention results in that a removable cover plate is arranged on an upper side of the cover hood. Through an opening of the cover hood at the upper side it is possible to influence the flow direction in a targeted way during suction. In the case of a substantially closed upper side with the cover plate, ambient air is drawn in essentially from the lower side, thus from the workpiece or from the direction of the workpiece. It can hereby be ensured that metal particles are removed from the ambient air in the area of the workpiece. By removing the cover plate and having an opening on the upper side, ambient air is drawn in from above, which can be desired for certain workpieces.

According to one further embodiment of the invention it is advantageous that the extraction hood and the coating lance are arranged on a mobile base carriage and that the extraction hood and/or the coating lance is/are mounted on the base carriage so that it/they can be moved at least in one direction. The base carriage can be part of a coating device, wherein with the base carriage the coating lance can be moved into the bores of the workpiece for example to be coated. The extraction hood and/or the coating lance can be movably mounted on a frame of the base carriage. In particular the extraction hood and the coating lance can be moved linearly in an axial direction extending parallel to the longitudinal axis of the coating lance. In addition the coating lance is preferably mounted to be rotatable about the longitudinal axis in order to coat for example a rotationally symmetrical bore.

The object set out above is achieved with respect to the holding unit in that a drum-shaped base body is provided with a peripheral wall and at least one annular edge element which is arranged at one end of the peripheral wall and extends radially inwards.

The holding unit is preferably arranged on a device for metallic coating of a workpiece with a coating lance, as previously described. The drum-shaped holding unit can also be used on a coating device without an extraction hood. The drum-shaped holding unit is used, during a continuous operation of the metal plasma jet of the coating lance, to receive the metal plasma jet when the coating lance has been moved out of the workpiece. The excess metal particles sprayed are thus collected in a targeted way by the holding unit. One or preferably both of the annular edge elements support the taking up of the metal particles as far as possible in the holding unit. When a fill limit of the holding unit is reached it can be replaced by a fresh holding unit.

In principle the holding unit can be produced from any suitable material. It is particularly advantageous according to one development of the invention that the base body is produced from sheet metal. The molten metal particles adhere particularly well to the metallic thin-walled sheet metal body. In addition the sheet metal body with a wall thickness of between 0.5 and 5 mm has a sufficient strength so that metal particles with a mass of several kilos can be deposited. In addition a holding unit made of metal can be cost-effectively recycled.

In principle the holding unit can be produced as an integral element by deep drawing, pressure forming, casting or forging. In principle the base body can be welded together, for example from annular elements. One advantageous variant of the invention exists in that the base body is constructed from sub-segments. The base body can thus be constructed from two half shells which are put together on a bottom plate of the extraction hood for the drum-shaped holding unit. A plurality of sub-segments can also be provided so that, all in all, the individual sub-segments can be more easily handled.

With respect to the method the task mentioned at the start is achieved by at least an axial portion of the coating lance being annularly enclosed by an extraction hood, through which an air flow is generated, by means of which ambient air containing metal particles is removed.

With the method, in particular an overspray can be reliably removed during the coating and also during the transport phase of the coating lance directly at the coating lance. Through a corresponding air flow, ambient air with the metal particles still located therein is drawn in and in particular removed to a filter device. The method can be carried out in particular with the previously described device for metallic coating.

One advantageous variant of the method according to the invention exist in that the air flow is generated by means of a flow device which is connected via a ventilation duct to the extraction hood. By means of this ventilation duct the ambient air containing metal particles can be reliably removed from the workpiece and the area around the coating lance.

According to a further embodiment of the method according to the invention it is advantageous that the coating lance is moved out of the workpiece into the extraction hood with a holding unit, wherein the metal plasma jet is directed onto the holding unit and metal particles deposit on a peripheral wall of the holding unit. The holding unit thereby constitutes a replaceable part which takes up excess metal particles in a targeted way and can be replaced when it is filled accordingly.

According to one further variant of the invention it is thereby useful that the holding unit is exchanged at predefined time intervals and/or when a predefined amount of deposits thereon is reached. The amount deposited can be determined in particular by means of sensors, for example with an optical sensor for layer thickness measurement or a force measurement sensor to measure the weight of the holding unit, or by computer based on operating data.

The invention will be described further below by reference to the preferred exemplary embodiments that are schematically shown in the attached drawings, in which.

Figure 1:
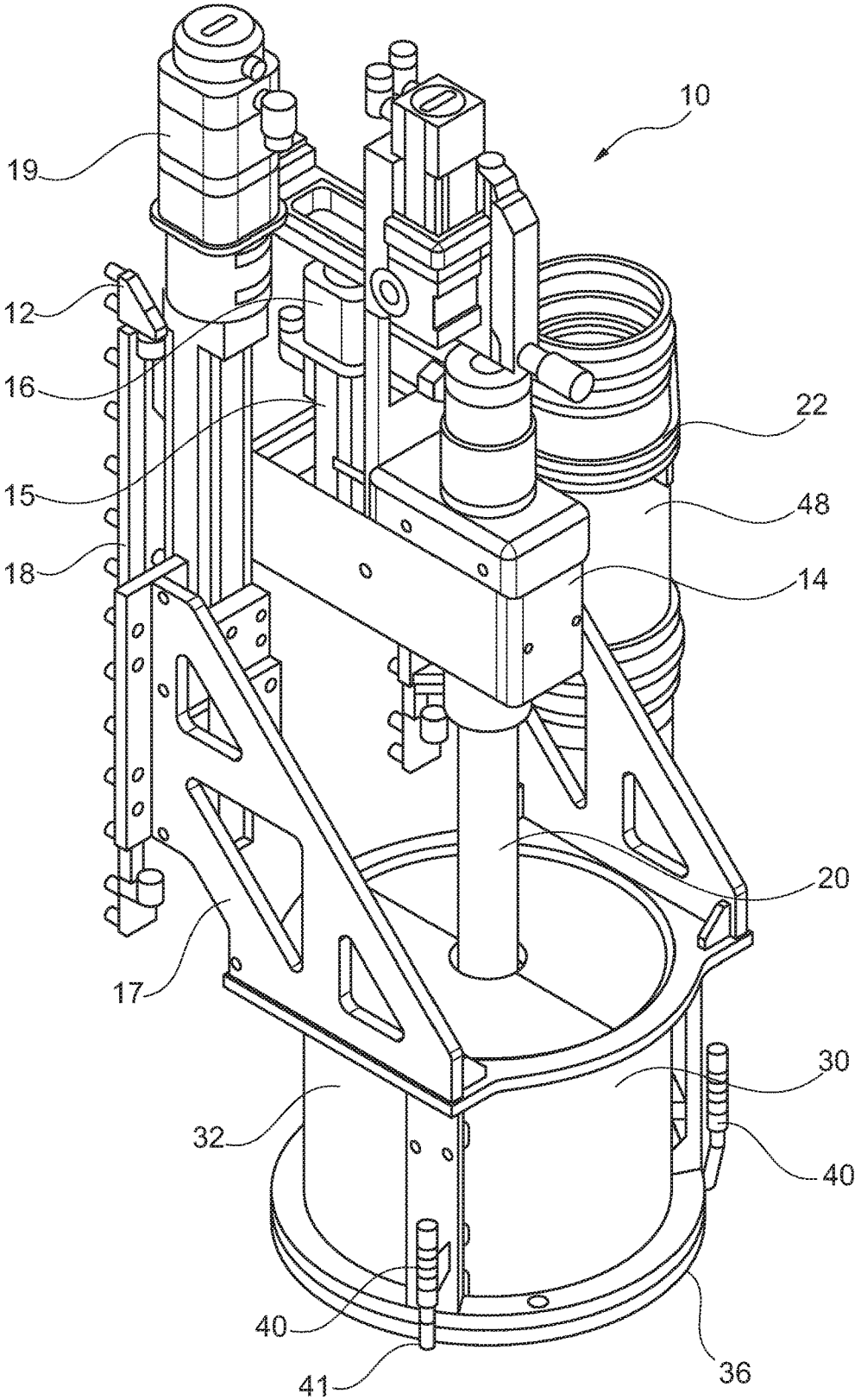
FIG. 1 shows a schematic perspective view of a device according to the invention for metallic coating.
Figure 2:
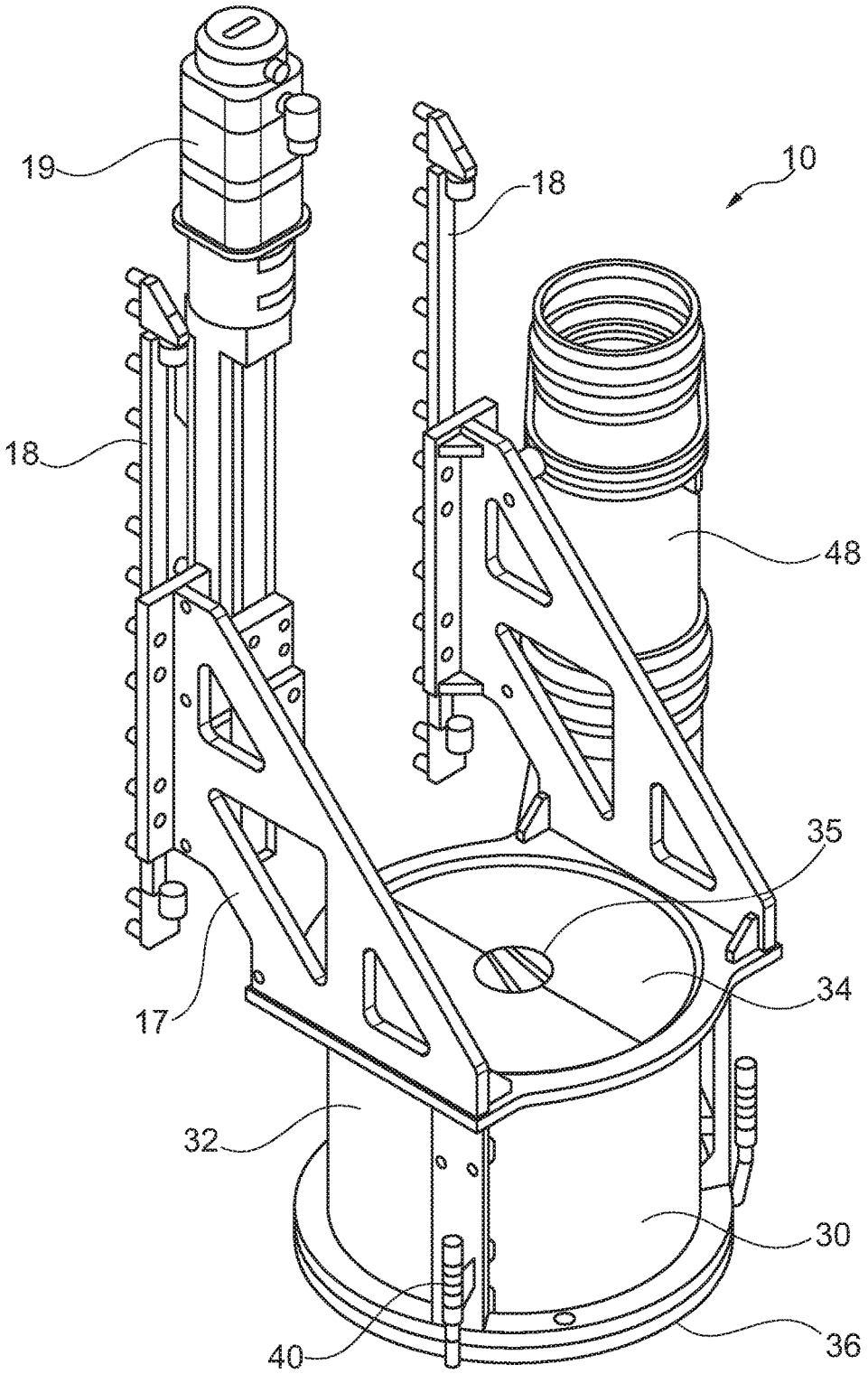
FIG. 2 shows a schematic perspective view of the device of FIG. 1, but without a coating lance.

A device 10 according to the invention for the metallic coating of a workpiece (not shown) is illustrated in its main parts in FIGS. 1 and 2. The workpiece can be in particular an engine block, of which the cylinder bores are provided with a metal coating. To form the metal coating, a rod-shaped coating lance 20 is used, which is known in principle and generates a metal plasma jet. Through this substantially radially directed metal plasma jet, metal particles are applied at high speed to the workpiece wall to be coated, wherein a solid, thin-walled metal coating is formed. The structure and the operating mode of such a coating lance have long since been known. The device 10 can additionally have a base frame (not shown) as well as feed and positioning devices for the workpiece.

The shaft-form coating lance 20 with the associated base unit 22 is held on a lance carriage 14 which can be moved relative to a base carriage 12, which is only indicated schematically, in a vertical direction along a lance guide 15 by means of a lance linear drive 16. Furthermore the coating lance 20 is mounted so that it can be rotated and driven around its vertical longitudinal axis in order to coat an inner wall of a cylinder bore with a radially directed metal plasma jet.

Furthermore an extraction hood 30 is mounted on the base carriage 12 by means of a hood carriage 17 so as to be movable in the vertical direction and parallel to the direction of movement of the lance carriage 14. Two rail-like hood guides 18 are arranged for this purpose on the base carriage 12, with which the hood carriage 17 is connected in a guiding manner via sliding blocks. A linear displacement is brought about by means of a linear drive 19. The base carriage 12 itself is mounted so that it can be moved relative to the base frame of the device 10 in several directions. A cylindrical or drum-shaped cover hood 32 is fastened to the frame-like hood carriage 17 of the extraction hood 30.

Figure 3:
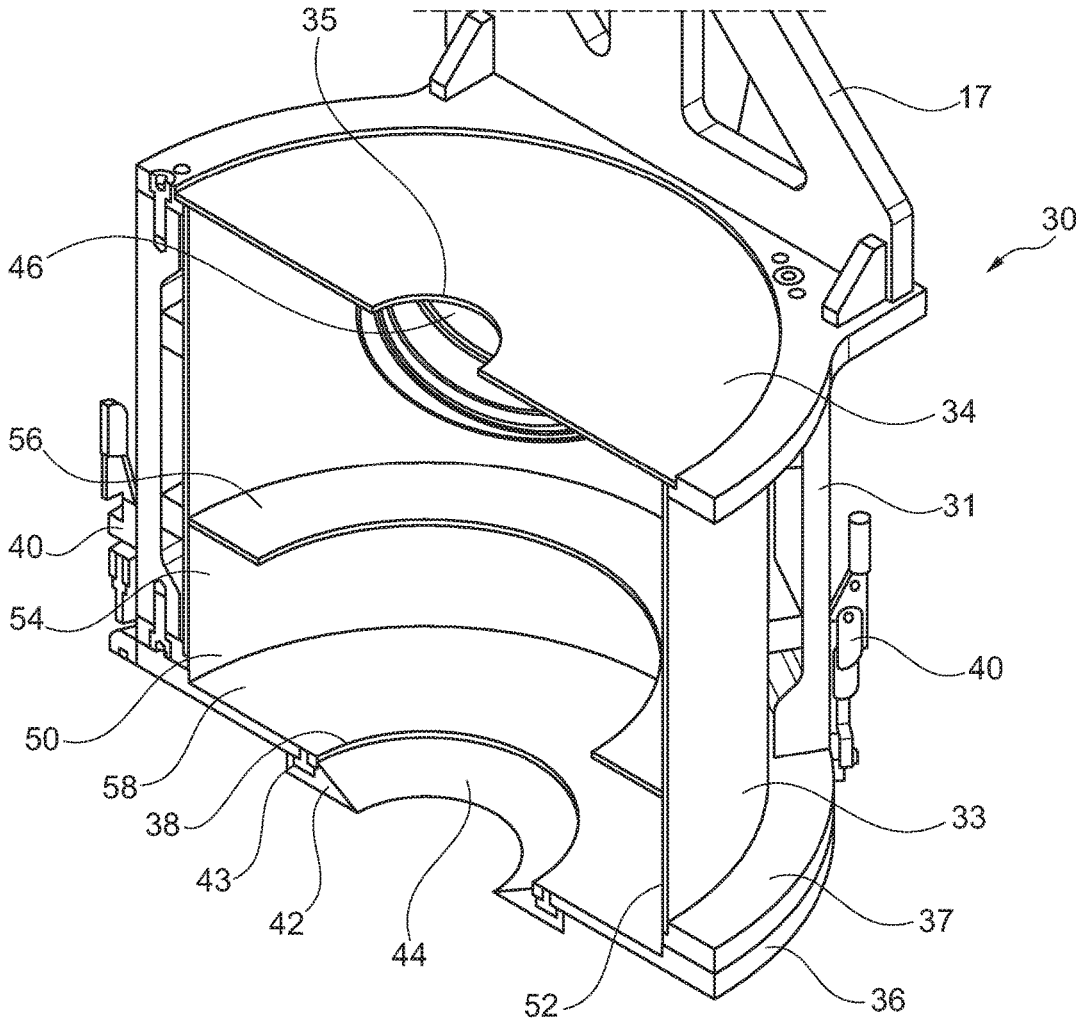
FIG. 3 shows an enlarged cross-sectional view with respect to the extraction hood according to the device of FIGS. 1 and 2.

By reference also to FIG. 3, the structure of the extraction hood 30 is explained in more detail. The cover hood 32 is produced from sheet metal and is arranged in a holding frame 31 which is fastened to the hood carriage 17. The cover hood 32 has a cylindrical wall 33 which is closed at its upper side by a cover plate 34. The cover plate 34 is designed in two parts and has a central through opening 35 for passage of the coating lance 20. A discharge opening 46 is incorporated in the cylindrical wall 33, via which ambient air containing metal particles can be drawn out of the inner space of the cover hood 32 during operation via a ventilation duct 48 by means of a flow device (not shown), in particular a pump, and carried away to a filter device. The cover plate 34 is releasably arranged and can be removed to influence the flow conditions.

At its lower side the cover hood 32 is closed by an annular bottom plate 36 which is fastened in the present exemplary embodiment via three quick release devices 40 releasably on a lower annular brace 37 of the holding frame 31. For this, radially projecting hook elements 41 are provided on the radial outer edge of the bottom plate 36 which can be connected to a clamping bracket of the quick release device 40.

To allow the coating lance 20 to pass through the bottom plate 36, the bottom plate 36 has a central opening 38, along which an annular flange 42 is mounted resiliently via spring elements 43 and is held on the bottom plate 36. The resilient mounting of the annular flange 42 allows a precisely fitting, flexible placing of the extraction hood 30 on a workpiece.

The annular flange 42 has on its radial inner side a conical surface 44 with an upwardly directed angle of inclination of approximately 30°. Upon passage of the coating lance 20 out of the workpiece into the extraction hood 30 during a continuous metal plasma jet, metal particles impacting on the conical surface 44 are deflected to a great extent and guided into a drum-shaped holding unit 50, which is mounted on the bottom plate 36 in the extraction hood 30. To avoid undesired deposits on the conical surface 44, this conical surface 44 is provided with an anti-adhesion property through a corresponding material selection and surface treatment.

Figure 4:
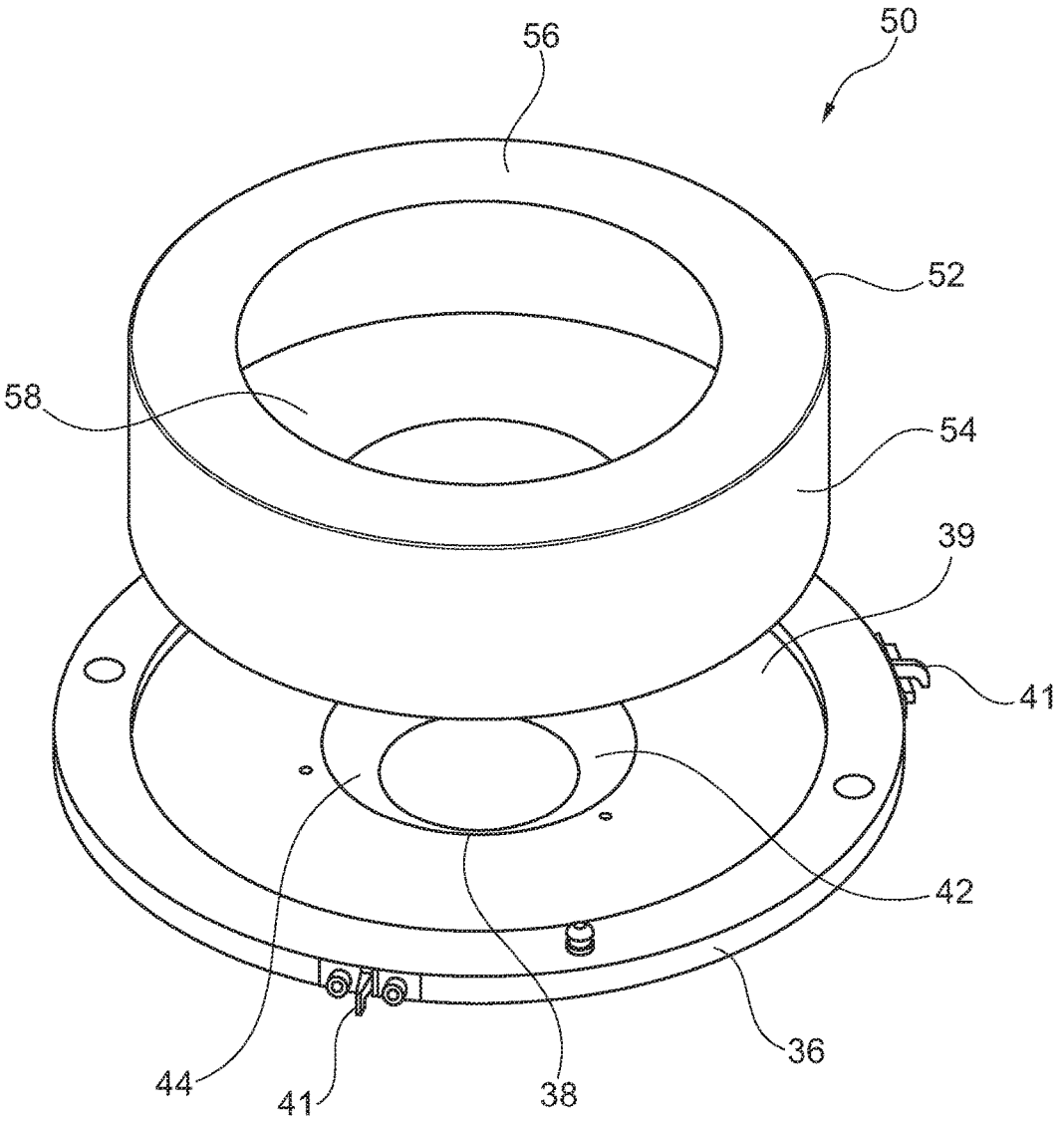
FIG. 4 shows an enlarged perspective view of a holding unit according to the invention.

The structure of a holding unit 50 according to the invention for the device 10 according to the invention is shown in more detail in FIG. 4. The drum-shaped holding unit 50 has a base body 52 of sheet metal which comprises a cylindrical peripheral wall 54 produced from a curved and welded sheet metal strip. At the upper end of the peripheral wall 54 an annular upper edge element 56 is welded. Correspondingly an annular lower edge element 58 is welded at the lower end of the peripheral wall 54. Both edge elements 56, 58 are radially inwardly orientated and enclose an annular collection space.

The lower edge element 58 has a larger radial extension than the upper edge element 56 and is adapted to an annular recess 39 in the bottom plate 36. The lower edge element 58 extends as far as the central opening 38 in the bottom plate 36, at which the conical surface 44 of the annular flange 42 begins. It is hereby ensured that, when the coating lance 20 is moved in with continuous metal plasma jet, the metal particles in the extraction hood 30 extensively reach an inner side of the peripheral wall 54 of the holding unit 50. When the coating lance 20 is moved in the extraction hood 30 in a moved-in end position, the metal plasma jet is directed approximately centrally onto an inner side of the peripheral wall 54. The upper edge element 56 and the lower edge element 58 ensure that metal particles do not leave the holding unit 50 upwards or downwards.

During operation the coating lance 20 is moved into the extraction hood 30 with continuing metal plasma jet whenever the coating lance 20 is moved relatively from one workpiece bore to be coated to the next workpiece bore to be coated. During this movement process with the base carriage 12 the coating lance 20 is further rotated so that the continuous metal plasma jet forms a metal deposit on the inner side of the peripheral wall 54 of the holding unit 50. As soon as this metal deposit has reached a predetermined maximum amount, which can be a few kilos, the holding unit 50 is replaced by a new holding unit 50. For this, the quick release devices 40 are released so that the bottom plate 36 with the holding unit 50 lying on it is separated from the cover hood 32 arranged above. In this state the holding unit 50 can be removed and replaced by a new holding unit 50. Subsequently the cover hood 32 is placed on the bottom plate 36 again and both parts are reconnected by means of the quick release devices 40. Subsequently the coating of the workpieces can be continued. Furthermore ambient air of the coating lance 20 is drawn off via the suction hood 30. The suction or drawing-off is realised both during the coating of the workpiece and also while the coating lance 20 has been moved into the extraction hood 30. In this way overspray, which in particular is also produced if the metal plasma jet is directed onto the holding unit 50, is removed.

The invention claimed is:

1. A device for metallic coating of a workpiece having a coating lance, through which a metal plasma jet can be generated to form the coating of metal particles, wherein ambient air can be removed from the coating lance with an overspray of metal particles via a waste air pipe, wherein an extraction hood, which annularly encloses at least an axial portion of the coating lance, is provided to draw off the ambient air, the extraction hood and the coating lance are arranged on a mobile base carriage, the coating lance is mounted so that the coating lance can be moved on the mobile base carriage at least in one direction, the extraction hood has, on the mobile base carriage, an annular holding unit which is designed for depositing of metal particles, the extraction hood has a cover hood and a bottom plate, which is arranged on a lower side of the cover hood, the annular holding unit is arranged releasably on the bottom plate, the annular holding unit is mounted within the extraction hood so that the annular holding unit can be replaced, the annular holding unit comprises a drum-shaped base body, which is provided with a peripheral wall, an annular upper edge element, and an annular lower edge element, wherein each of the annular upper edge element and the annular lower edge element is arranged at an end of the peripheral wall and extends radially inwards, and the annular holding unit is designed to be releasably arranged on the bottom plate of the extraction hood of the device.

2. The device according to claim 1, wherein the bottom plate is releasably fastened to the cover hood by means of at least one quick release device.

3. The device according to claim 1, wherein the bottom plate has a central opening, on which an annular flange is provided, which has a radially inwardly falling conical surface.

4. The device according to claim 3, wherein the conical surface is formed with an anti-adhesion property.

5. The device according to claim 1, wherein a removable cover plate is arranged at an upper side of the cover hood.

6. The device according to claim 1, wherein the extraction hood is mounted so that the extraction hood can be moved on the mobile base carriage at least in one direction.

7. The device according to claim 1, wherein the base body is produced from sheet metal.

8. The device according to claim 1, wherein the base body is constructed from sub-segments.

9. A method for metallic coating of a workpiece, wherein a metal plasma jet is generated by means of a coating lance, through which the coating of metal particles is formed on the workpiece, wherein a device is used, wherein ambient air can be removed from the coating lance with an overspray of metal particles via a waste air pipe, the device comprising:

an extraction hood, which annularly encloses at least an axial portion of the coating lance, is provided to draw off the ambient air, wherein the extraction hood and the coating lance are arranged on a mobile base carriage, the coating lance is mounted so that the coating lance can be moved on the mobile base carriage at least in one direction, the extraction hood has, on the mobile base carriage, an annular holding unit which is designed for depositing of metal particles, the extraction hood has a cover hood and a bottom plate, which is arranged on a lower side of the cover hood, the annular holding unit is arranged releasably on the bottom plate, the annular holding unit is mounted within the extraction hood so that the annular holding unit can be replaced, the annular holding unit comprises a drum-shaped base body, which is provided with a peripheral wall, an annular upper edge element, and an annular lower edge element, wherein each of the annular upper edge element and the annular lower edge element is arranged at an end of the peripheral wall and extends radially inwards, and the annular holding unit is designed to be releasably arranged on the bottom plate of the extraction hood of the device, the method comprising:

arranging the extraction hood and the coating lance on the mobile base carriage, and the extraction hood has, on the mobile base carriage, the annular holding unit, wherein at least the axial portion of the coating lance is enclosed annularly by the extraction hood, through which an air flow is generated, by means of which ambient air containing metal particles is removed, moving the coating lance, with continuing metal plasma jet, into the annular holding unit, and depositing metal particles on the holding unit in the extraction hood on the mobile base carriage, wherein the extraction hood has the cover hood and the bottom plate, which is arranged on the lower side of the cover hood, and the annular holding unit is arranged releasably on the bottom plate.

10. The method according to claim 9, wherein the air flow is generated by means of a flow device which is connected via a ventilation duct to the extraction hood.

11. The method according to claim 9, wherein the coating lance is moved out of the workpiece into the extraction hood with a holding unit, wherein the metal plasma jet is directed onto the holding unit and metal particles deposit on a peripheral wall of the holding unit.

12. The method according to claim 11, wherein the holding unit is exchanged at predefined time intervals and/or when a predefined amount of deposits is reached.

* * * * *